US006094770A

United States Patent [19]

Benarrouch

[11] Patent Number: 6,094,770

[45] Date of Patent: Aug. 1, 2000

[54] WASHING AND/OR SCOURING DEVICE FOR MANUAL USE

[76] Inventor: Jacques Benarrouch, 20, rue Clément Michut, F-69100 Villeurbanne, France

[21] Appl. No.: 09/155,970

[22] PCT Filed: Feb. 5, 1998

[86] PCT No.: PCT/FR98/00204

§ 371 Date: Jan. 19, 1999

§ 102(e) Date: Jan. 19, 1999

[87] PCT Pub. No.: WO98/35605

PCT Pub. Date: Aug. 20, 1998

[30] Foreign Application Priority Data

Feb. 12, 1997 [FR] France ..... 97 01836

[51] Int. Cl.[7] ..... A47L 13/10; A47L 17/04

[52] U.S. Cl. ..... 15/209.1; 15/229.13

[58] Field of Search ..... 15/209.1, 210.1, 15/229.3, 229.7, 229.13

[56] References Cited

U.S. PATENT DOCUMENTS

| | | | |
|---|---|---|---|
| 1,585,006 | 5/1926 | Zell | 15/229.3 |
| 1,686,526 | 10/1928 | Lacy | 15/229.13 |
| 2,609,236 | 9/1952 | Myshock | 15/229.3 |
| 2,870,472 | 1/1959 | Hartmann | 15/229.3 |
| 4,829,622 | 5/1989 | O'Sullivan | 15/229.3 |

FOREIGN PATENT DOCUMENTS

| | | | |
|---|---|---|---|
| 0757126 | 9/1956 | United Kingdom | 15/229.3 |

*Primary Examiner*—Randall E. Chin
*Attorney, Agent, or Firm*—Thomas S. Baker, Jr.

[57] ABSTRACT

A scouring device for manual use has a support formed by folding two longitudinal parts about an axis of symmetry to provide a pad support having a handle which support mounts a pad for cleaning.

9 Claims, 2 Drawing Sheets

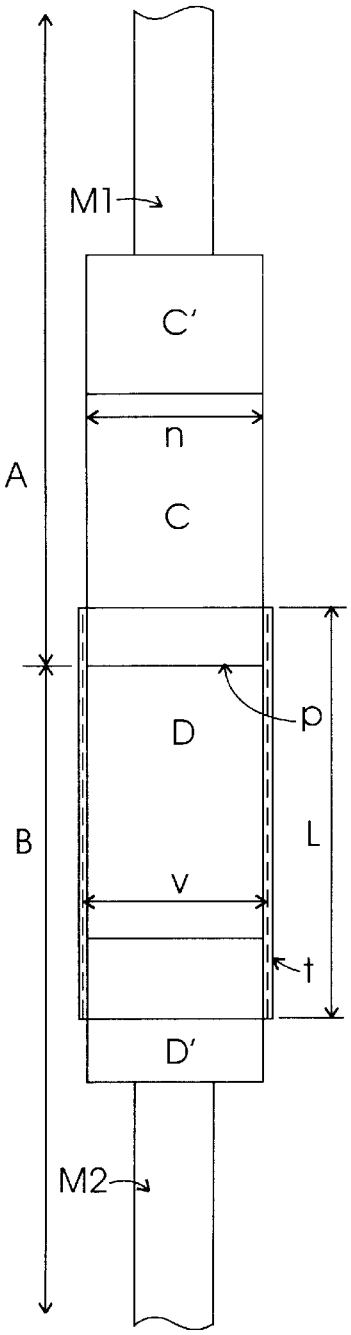
FIG. 1
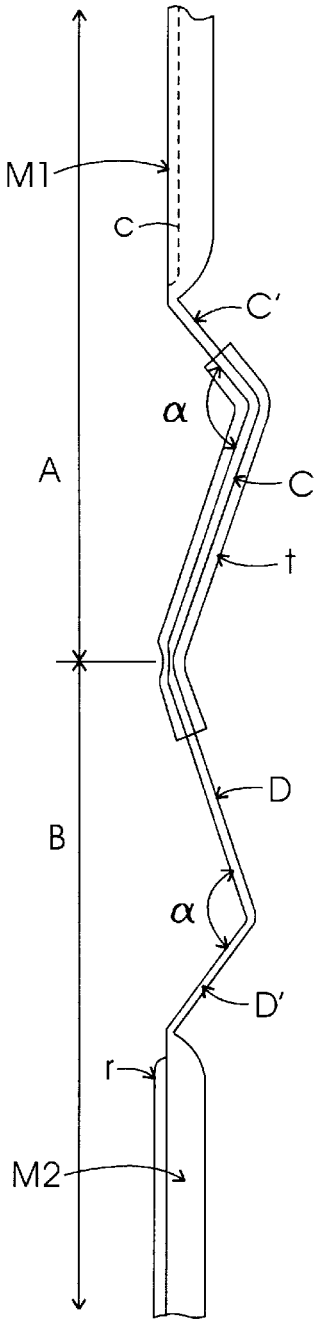
FIG. 2
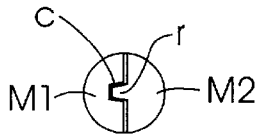
FIG. 3A
FIG. 3
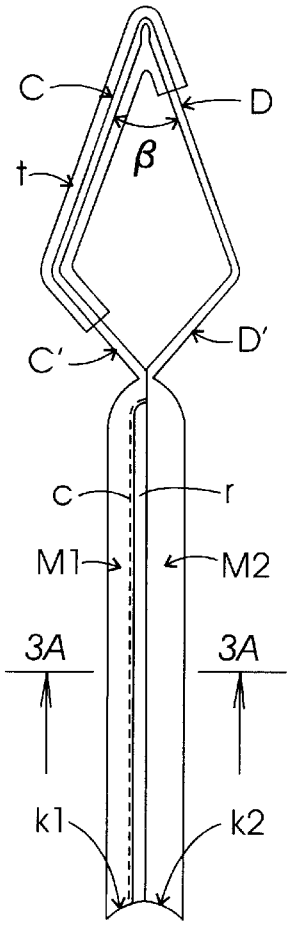

WASHING AND/OR SCOURING DEVICE FOR MANUAL USE

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Field of the Invention

This invention relates to a manual scrubbing device.

BRIEF SUMMARY OF THE INVENTION

A scouring device for manual use has a support formed by folding a pair of substantially identical longitudinal parts about a central hinge to form a pad mounting portion and a handle portion and a pad adapted to be mounted on the support.

DESCRIPTION OF THE DRAWINGS

FIG. 1 is a top view of the scouring device of the instant invention where the two symmetrical longitudinal parts forming the support have not been folded about their axis of symmetry;

FIG. 2 is a side view of the support and pad of FIG. 1;

FIG. 3 is a side view similar to FIG. 2 where the support has been folded about its axis of symmetry and the two pieces forming the handle section have been snapped together;

FIG. 3*a* is a sectional view along the line 3*a*—3*a* of FIG. 3;

DETAILED DESCRIPTION OF THE INVENTION

Figure 4:
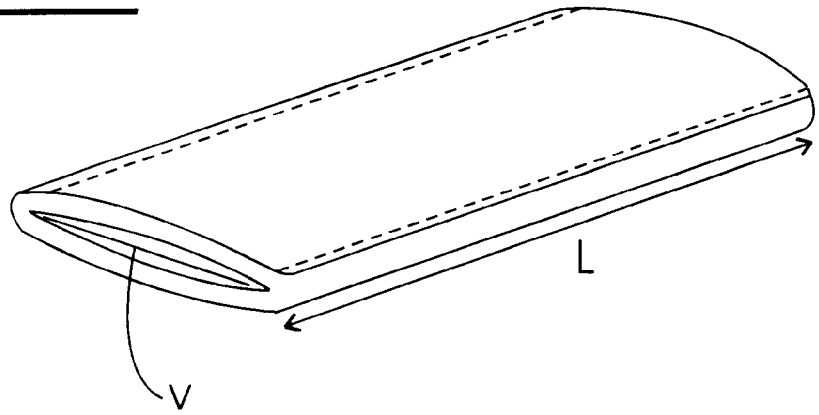
FIG. 4 is a perspective view of a sewn pad adapted to be mounted on the support illustrated in FIGS. 1 through 3.

The scouring device of the instant invention is comprised of two elements. The first is a support and the second is a sliding pad. The support shown in FIGS. 1 and 2 consists of two symmetrical longitudinal parts (A) and (B), preferably identical which can be arranged to extend lengthwise from a central hinge which folds along the device's axis of symmetry (p). The hinge has a width (n).

Each of the longitudinal parts (A) and (B) has a first parallelepiped element (C) and (D) respectively which is bent at a fixed obtuse angle ($\alpha$), with a second flat parallelepiped element (C') and (D'). The length of the second elements (C') and (D') may be different from or equal to that of the first elements In terms of their respective lengths, the length of (C) plus the length of (C') equals the length of (D) plus the length of (D'). The support further consists of a pair of third elements (M1) and (M2) where (M1) is formed of a longitudinal section extending in a straight line from previous section (C') and (M2) is formed of a longitudinal section which extends in a straight line from previous section (D'). The cross section of third elements (M1) and (M2) is generally semicircular in shape so that by rotation of 180° about the center hinge defined at fold line (P), third elements (M1) and (M2) can be joined together. See FIGS. 3 and 3*a*. Elements (M1) and (M2) are snapped longitudinally in place by means of a center longitudinal rail (r) formed in and extending from element (M2) which through manual pressure, penetrates a central longitudinal cavity (c) which faces rail (r) and is formed within the volume defined by third element (M1). The length of cavity (c) is slightly greater than the length of rail (r). The depth of cavity (c) is slightly greater than the height of rail (r). The cross sections of rail (r) and cavity (c) are isosceles trapezoids of identical slope. The male rail section (r) is slightly sturdier than the female section cavity (c) to ensure good closure with only slight pressure.

Once third elements (1) and (2) have been joined, they form the handle of the scouring device. Whenever it is necessary to separate them, they can be spread apart through the application of two gentle radial forces in opposing directions acting on corresponding grips (k1) and (k2) respectively, preferably arranged in symmetric recesses at the ends of elements (M1) and (M2) illustrated in FIG. 3.

The above description relates only to the version of the device where parts (A) and (B) are identical, although it is obvious that other useful configurations of parts (A) and (B) exist with different respective values for first elements (C) and (D) and second elements (C') and (D') so long as angle ($\alpha$) and angle ($\beta$) remain within operative values.

Regardless of the respective configurations of (C'), (C), (D), (D'); ($\alpha$) and ($\beta$), both handle elements (M1) and (M2) retain the specific features indicated in the description.

The second element of the device is a sliding pad (t) illustrated in FIGS. 1 through 4. Pad (t) preferably is composed of two panels of identical length and width and generally of identical thickness (although this is not essential if the two panels are made of different materials or if, to satisfy some specific requirement, the identical materials are of different thicknesses).

The description relates specifically to a scouring pad since vigorous scouring is the primary purpose of the device.

The two aforementioned panels shall be assumed to be of identical dimension and cut from a thick, flexible, commercially available scouring material consisting of abrasive fibers.

The two panels depicted in FIG. 4, are superimposed and their edges are sewn longitudinally along length (L), with a distance (v) between the seams being slightly greater than the width (n) of support elements, (C'), (D) and (D'). The pad thus obtained after realization of the two lateral seams, is able to slide flat along the flat, parallelepiped elements (C), (C'), (D) and (D') whose edges are parallel and separated by distance (n), after having been introduced by the end of longitudinal section (M1) of the handle, (preferably being the element that does not contain the extending rail (r), for greater ease of use), the two longitudinal third elements (M1) and (M2) thus being in line with one another, from one end to the other end of the device when the device is open as shown in FIG. 2.

The length (L) of sliding pad (t) is equal to or slightly greater than the cumulative lengths of elements (C) and (C') or (D) and (D') so as not to interfere with the closure of the device when the longitudinal straight element sections (M1) and (M2) are snapped shut during use as illustrated in FIG. 3.

The two panels of the pad can also be cut from a flexible, spongy material (vegetable sponge or compact chemical foam), soft material (thick cotton, for example), etc. depending on the specific requirements.

The two panels of the pad can have different thicknesses. They can be of different materials sewn longitudinally (for example, one scouring side and one soft or spongy side). They can also be glued longitudinally along their opposing edges to cut costs during manufacture of the pads, provided that the glue used is chemically compatible with the material used for the scouring support.

Figure 5:
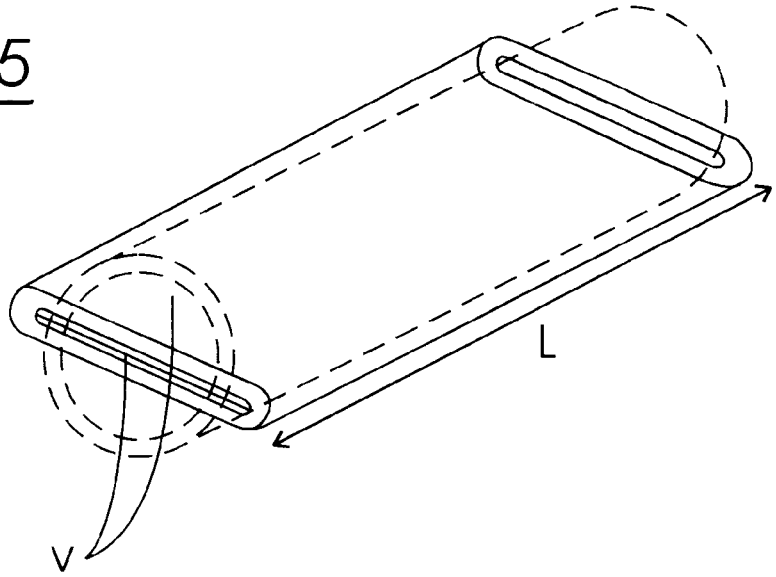
FIG. 5 is a perspective view of a tubular pad adapted to be mounted on the support illustrated in FIGS. 1 through 3.

Rather than using a two-sided pad cut from the same material with the same thickness, we can also use a thick tubular pad, shown in FIG. 5, cut, for example, from a commercially available, flexible scouring material consisting of abrasive fibers. In this case it is a longitudinally flattened pad of length (L) that must be inserted flat along elements (C'), (C), (D) and (D') for a distance that extends slightly beyond the hinge during the device's initial use. If (n) is the width of the support, the useful width of the flattened pad corresponds to (v) which is equal to or slightly greater than width (n).

This useful width is simply the half-circumference of a circle defined by the interior cross-section of the tube illustrated in FIG. 5. If the length of the circumference is described by the formula 2Π times the radius of a circle, the interior half-circumference is equal to Π times the radius of the interior circle. Thus, width (v) equals Π times the radius of the interior circle, which gives a useful radius for the circle formed by the interior cross-section of the tubular scouring pad of (v) divided by Π.

Obviously the thickness of the flexible tube of scouring material will have an operating limit relating to the value of the acute angle (β) between the flat parallelepiped elements (C) and (D) of the hinge to enable the support to close (FIG. 3) by joining the two longitudinal section (M1) and (M2) that form the handle.

Figure 6:
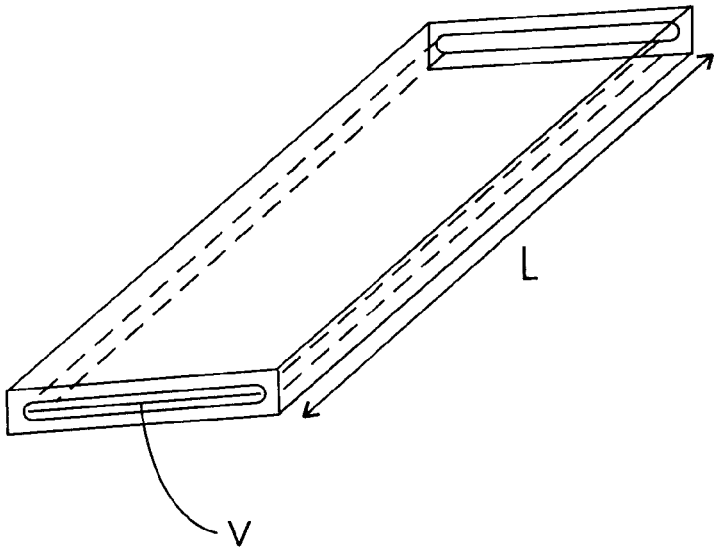
FIG. 6 is a perspective view of a parallelepiped pad adapted to be mounted on the support illustrated in FIGS. 1 through 3.

Finally, the pad described by the invention can be realized from a one-piece parallelepiped-shaped panel with a central hollow whose width (v) and whose height is adjusted for the thickness of the elements (C'), (C), (D), and (D') as shown in FIG. 6.

FIGS. 4 through 6 represent the three types of pads described above that are most suitable for the support according to the invention.

FIG. 4 represents a sewn pad, FIG. 5 represents a tubular pad employed flat, and FIG. 6 represents a one-piece parallelepiped pad whose center is hollow.

For manual industrial use it is appropriate to incorporate a robust support produced from a material with high mechanical strength and abrasive pads that are sufficiently flexible and of various hardness and composition depending on use. For example, to scour a sheet of stainless steel covered with oxidation pits, a specific pad must be used that does not contain any iron particles; this is to avoid recontaminating the metal being deoxidized. Another example would be the cleaning of a silver plated metal surface. Here a pad must be used whose external surfaces are extremely soft and covered with PTFE (Teflon®) to avoid scratching the surface being cleaned and even impart a shine.

For household use scouring frying pans, saucepans, dishes, stockpots, etc., the support will preferably be injection-molded of polypropylene from a mechanical release mold, primarily because of the handle design. After mechanical demolding, the two longitudinal sections (M1) and (M2) are joined and locked together under slight pressure and remain locked through pressure of the user's hand. This maintains the two sections in contact, one inside the other, during use of the device. The two hinged, flat parallelepiped elements (C) and (D), as well as their respective flat angular extensions, the flat parallelepiped elements (C') and (D'), all have a uniform thickness of between approximately 2 and 3 millimeters, providing sufficient mechanical strength for vigorous household scouring. The excess material on (C') and (D'), near the root of each of the two longitudinal sections (M1) and (M2) forming the handle, provide greater strength for the device during use, along either of its active surfaces, when strong pressure or a rubbing motion is applied to the surface being cleaned, whether said surface be flat, convex, or concave.

The center hinge between elements (C) and (D) can be a "natural" hinge, incorporated into the injection mold through simple reduction of the thickness of material at the throat (FIG. 2) along the length of fold line (p) toward the interior of angle (β) formed between elements (A) and (B). The thickness of the material at the throat may have a depth that is between ⅓ and ½ the thickness of the flat parallelepiped elements (C) or (D) and a throat width which varies with the desired angle (β) between elements (C) and (D), which angle should be between 35° and 45° to provide the best attack on the surface being scoured using one of the two active surfaces of the device.

We do not recommend that the exterior hinge angle between the external surfaces of elements (C) and (D) be too acute, since pressure from the scouring pad on the acute angle of the support when rubbed against the bottom surface of a vessel with vertical or similar sides may promote premature tearing of the scouring pad along the contact line of the pad covering the external edge of the hinge. The outside end of the support hinge must have sufficient roundness to avoid prematurely damaging the pad.

The opposed and preferably equal angles (α) between interior surfaces of elements (C) and (C') and interior surfaces of elements (D) and (D') should be between approximately 135° and 145° so that insertion of the pad when flat, preferably from the end of the longitudinal section (M1) of the handle (said handle element not having central longitudinal rail (r)), can easily be realized without the inconvenience of an excessively sharp angle, which would interfere with the movement of the pad toward the hinge or prevent such movement.

The operation of the device involves successive use of either surface of the pad, after said pad is reversed, which requires removal of the flat pad by the handle so that its opposite active surface is exposed, then gradual movement of the pad perpendicularly to the hinge along elements (C'), (C), (D) and (D') or in the opposite direction, in such a way that wear on the pad along the hinge can be periodically interrupted, that is, before it tears, and so the device can continue to operate with the pad in good condition near the hinge, until the pad is uniformly worn throughout its length on either side. By opening the device to its fullest extent of 180° at the hinge, (the two longitudinal sections (M1) and (M2) thus being approximately in a straight line with one another), the sliding pad can advance over the device. When the device is closed (the two longitudinal sections (M1) and (M2) thus being joined as a unit) the pad can be angularly locked in place along a portion of its width covering the hinge and showing no signs of wear.

I claim my inventions as follows:

1. A scouring device for manual use which comprises:

a support comprised of first and second symmetrical longitudinal parts joined lengthwise across their width about the fold line of a central hinge which hinge forms an axis of symmetry for said support and wherein each of said first and second longitudinal parts has a first flat parallelepiped element joined to a second flat parallelepiped element of the same width at a fixed obtuse angle of between 135° and 145° and a third element joined to said second element and having a longitudinal section extending in a straight line and having a semicircular cross section, wherein one of said third element longitudinal sections has a longitudinal central cavity and the other of said third element longitudinal sections has a longitudinal rail such that said rail firmly resides within said cavity such that said one and said other third elements form a handle when said first and second parts are rotated 180° about said hinge to join said one and said other third elements together and wherein said first flat parallelepiped elements of said first and second longitudinal parts are joined at an acute angle of between 35° and 45° when said one and said other third element are joined together; and a pad having a length substantially equal to or greater than the cumulative lengths of one of said first and second elements, a width substantially equal to that of said first and second elements and wherein said pad can move along said pairs of first and second elements and will be fastened in any of a plurality of positions when said one and said other third elements are brought together.

2. The scouring device according to claim 1 wherein said rail has an isosceles trapezoid cross section.

3. The scouring device according to claim 1, characterized in that the pad comprises two superimposed panels sewn together along the edges of their sides to define a width between said sewed edges slightly greater than the width of said first and second elements.

4. The scouring device according to claim 1, characterized in that the pad is tubular, and has a width defined by the value of the half-circumference of the circle forming the interior cross-section of the tubular pad which width is slightly greater than the width of said first and second elements.

5. The scouring device according to claim 1, characterized in that the pad is formed from a panel whose cross-section is a parallelepiped having an opening slightly greater than the width of said first and second elements.

6. The scouring device according to claim 1, characterized in that the separation of said one and said other third element occurs through the application of two opposing radial forces applied at one of the ends of said one and said other third elements.

7. A scouring device for manual use which comprises:

a support comprised of first and second symmetrical longitudinal parts joined lengthwise across their width about the fold line of a central hinge which hinge forms an axis of symmetry for said support and wherein each of said first and second longitudinal parts has a first flat parallelepiped element joined to a second flat parallelepiped element of the same width at a fixed obtuse angle and a third element joined to said second element and having a longitudinal section extending in a straight line said third elements incorporating locking means for locking said third elements together such that said third elements form a handle when said first and second parts are rotated 180° about said hinge to join said third elements together; and a pad having a width substantially equal to that of one of said first and second elements and wherein said pad can move along said pairs of first and second elements and will be fastened in any of a plurality of positions when said third elements are joined together.

8. The scouring device according to claim 7 wherein said support is formed by injection-molding.

9. The scouring device according to claim 7 wherein said support is formed of polypropylene.

* * * * *